US006709310B1

(12) United States Patent
Pietrafesa

(10) Patent No.: US 6,709,310 B1
(45) Date of Patent: Mar. 23, 2004

(54) SOFT-BODIED DRINK AND WET DOLL

(75) Inventor: Michael Pietrafesa, Brooklyn, NY (US)

(73) Assignee: Goldberger Doll Co., Brooklyn, NY (US)

( * ) Notice: Subject to any disclaimer, the term of this patent is extended or adjusted under 35 U.S.C. 154(b) by 0 days.

(21) Appl. No.: 10/353,729

(22) Filed: Jan. 29, 2003

Related U.S. Application Data

(60) Provisional application No. 60/352,801, filed on Jan. 29, 2002.

(51) Int. Cl.[7] ..... A63H 3/24

(52) U.S. Cl. ..... 446/305; 446/304; 446/369; 446/268

(58) Field of Search ..... 446/304, 305, 446/268, 369, 370, 373, 385, 306

(56) References Cited

U.S. PATENT DOCUMENTS

| | | | | | |
|---|---|---|---|---|---|
| 2,012,060 | A | * | 8/1935 | Wittmann | 446/304 |
| 2,157,763 | A | * | 5/1939 | Konikoff et al. | 446/305 |
| 2,945,321 | A | * | 7/1960 | Carter | 446/305 |
| 3,490,170 | A | * | 1/1970 | Wolf | 446/305 |
| 3,839,819 | A | * | 10/1974 | Hollingsworth et al. | 446/305 |
| 3,858,352 | A | * | 1/1975 | Cummings et al. | 446/305 |
| 3,959,919 | A | * | 6/1976 | Baulard-Cogan | 446/305 |
| 4,060,932 | A | * | 12/1977 | Leto et al. | 446/295 |
| 4,115,948 | A | * | 9/1978 | Burks | 446/305 |
| 4,151,675 | A | * | 5/1979 | Juan | 446/305 |
| 4,160,338 | A | * | 7/1979 | Lyons et al. | 446/184 |
| 4,257,188 | A | * | 3/1981 | Barker | 446/295 |
| 4,413,441 | A | * | 11/1983 | Hunter et al. | 446/305 |
| 4,504,241 | A | * | 3/1985 | Dyson et al. | 446/304 |
| 4,728,313 | A | * | 3/1988 | Thomas | 446/369 |
| 5,083,965 | A | * | 1/1992 | Mayem | 446/305 |
| 5,094,644 | A | * | 3/1992 | Kelley | 446/305 |
| 5,941,750 | A | * | 8/1999 | Pracas | 446/130 |

FOREIGN PATENT DOCUMENTS

| | | | | | |
|---|---|---|---|---|---|
| JP | 07000639 | A | * | 1/1995 | A63H/3/24 |

* cited by examiner

*Primary Examiner*—Derris H. Banks
*Assistant Examiner*—Urszula M Cegielnik
(74) *Attorney, Agent, or Firm*—Bradley N. Ruben

(57) ABSTRACT

A soft-bodied drink-and-wet doll having a hard head and a hard butt or crotch area, a soft, stuffed body connecting the head and butt areas, and a fluid conduit connecting the mouth in the head and a hole in the butt. The hard butt area avoids liquid "evacuated" by the doll from being absorbed by the soft body portion.

8 Claims, 1 Drawing Sheet

SOFT-BODIED DRINK AND WET DOLL

CROSS REFERENCE TO RELATED APPLICATIONS

This application claims the benefit of U.S. Provisional Application No. 60/352,801, filed Jan. 29, 2002.

BACKGROUND OF THE INVENTION

1. Field of the Invention.

This invention is directed to a doll construction allowing for a soft-bodied doll to have drink-and-wet features, and to a method for manufacting such dolls.

2. State of the Art.

Childrens' dolls have existed for millenia. Typically, the designer's intent is to provide a doll that is as life-like as possible, balanced against the costs of manufacturing and distributing the doll. One of the most "life-like" qualities a doll can display is the ability to be "fed" a liquid and to "evacuate" the liquid, a so-called drink-and-wet doll. Such dolls are typically constructed with a hard or plastic body, having a head section with a hole where the mouth is located, and a hole in the crotch area, and some sort of plumbing connecting the two holes. When a toy baby bottle is filled with liquid (water, typically) and used to feed the doll, the liquid from the bottle enters the hole in the mouth, flows through the plumbing, and exits in the crotch area.

Hunter et al., in U.S. Pat. No. 4,413,441, the disclosure of which is incorporated herein by reference, describes a "multiple function doll" (e.g., including a mechanism for hand-clapping, speaking, etc.) that includes the basic structure of a hard body head with a hole in the mouth section, a hard body housing the multiple function generators, and a hard body crotch area having a hole, with a tube joining the two holes. The doll also includes a pinch valve so that the doll will not wet until it is placed on a simulated chamber-pot. This patent does disclose that such a doll can be constructed of a material including soft cloth, but provides no other details about the specific construction of such a doll.

Ellman et al., in U.S. Pat. No. 3,775,901, describes a hard-bodied doll having a liquid reservoir therein, filled from the doll's mouth, and a valving mechanism allowing the doll to wet when the mechanism is activated.

In another prior art doll, a soft-bodied doll having a typical hard plastic head was provided with a tube from the mouth to a cloth (soft-bodied) crotch area. The tube was secured to a hole in the crotch area with a grommet attached to the cloth.

Soft-bodied dolls are generally more popular than hard-bodied dolls, especially for a doll simulating an infant or child. However, providing a drink-and-wet function for a soft-bodied doll creates the problem of the doll getting wet at least in the butt and/or crotch area: the soft material of the body absorbs the water (or other liquid) the child feeds to the doll, which can lead to mold or mildew problems. Another problem is that the connection between the tube and the butt or crotch region must be attached directly to the fabric without compromising the fluid conduit from the mouth; and attachment of a tube or grommet directly to fabric can result in weak points and stresses in the fabric at the point of attachment.

SUMMARY AND OBJECTS OF THE INVENTION

In light of the following, one object of this invention is to provide a soft-bodied doll that exhibits a drink and wet function without the problem of the soft body portion becoming wet or absorbing the liquid evacuated by the doll. Another object is to provide a soft-bodied drink and wet doll with better "plumbing" connections between the mouth and the crotch areas, thereby reducing stress in the soft body fabric in the butt or crotch region. Thus, a related object is providing a soft-bodied drink-and-wet doll where the fluid connection at the butt or crotch area is sturdier than prior art techniques.

As such, in summary this invention provides a doll comprising a hard head having a mouth portion with a hole leading to a coupling, a hard butt portion having a crotch portion with a hole leading to a coupling, a soft body connecting the head and crotch portions, and a tube (or other liquid conduit) connecting the two couplings.

DETAILED DESCRIPTION OF SPECIFIC EMBODIMENTS

Figure 1:
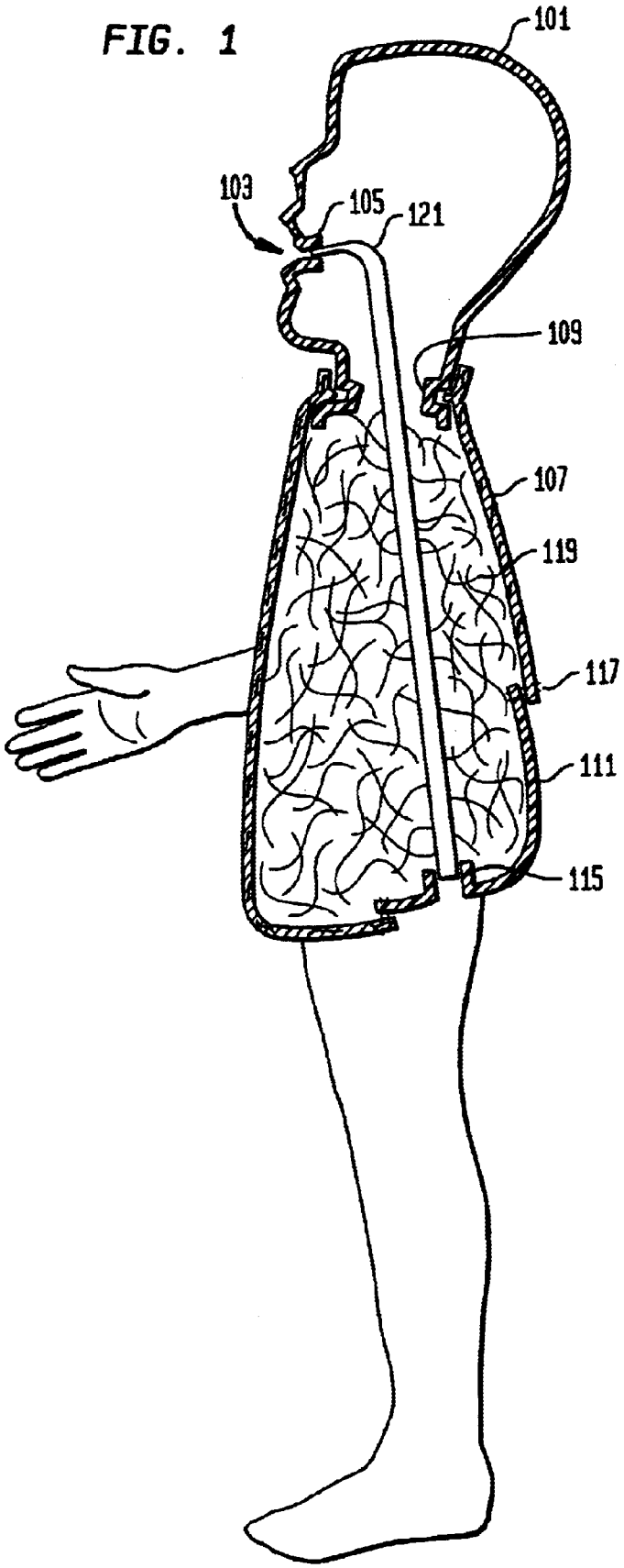
FIG. 1 is a cross-sectional view of one embodiment of the doll of this invention.

The invention can be understood with reference to FIG. 1, which is a cross-sectional view of an embodiment of this doll of this invention. The doll comprises a head 101 having a mouth section including an opening 103. Inside the head, the opening continues through to a nipple or coupling 105 on the inside of the doll. The main body of the doll is constructed of a soft, fabric material 107. The soft fabric is joined to the head preferably by means of a channel 109 in the neck portion of the head, enabling a securing device (not shown) to secure the top portion of the fabric in the channel by a tie (such as a plastic tie, rubber band, or thread/twine) that fits in the channel; of course, the soft body could also be connected to the head by sewing.

The doll is also provided with a hard butt area 111 having a crotch portion with a hole continuing through the butt section to a second nipple or coupling 115 on the inside of the doll.

The soft body is connected to the butt area preferably by sewing 117 though both the fabric and the butt.

The interior of the body has batting or wadding 119 providing substance to the soft section.

Connecting the couplings 105 and 115 is a tube 121 or other conduit for liquids. As shown, the tube OD (outer diameter) is sized effectively to frictionally fit within the ID (inner diameter) of each of the couplings; most preferably, a permanent, waterproof adhesive is used to secure each end of the tube to a respective coupling. Of course, the tube could be sized such that its ID allows it to frictionally engage the OD of the coupling, and optionally secured also with a permanent adhesive. Although not as preferred, a clamp can be used to secure the tube (or other conduit) to the coupling, or a threaded engagement could be used (but is typically too expensive for these types of goods). Also, the doll could include a pinch valve as in the above-described Hunter patent.

The doll is manufactured generally by sewing the butt to the soft body covering, attaching one end of the conduit to the coupling at the butt, placing the stuffing in the doll, attaching the other end of the conduit to the coupling in the head, and attaching the head to the body. The arms/hand and/or legs/feet may also be of plastic, and if so are attached in a conventional manner.

As used herein, a "hard" material is actually a soft, plasticized polymeric material as is conventionally used for dolls and various portions thereof. The soft material is preferably a fabric, but could also be a polymeric film material; a film, typically having a thickness of 1–20 mils, would be considered soft in contrast with the hard polymeric material, typically having a thickness of about ⅛ th inch. Thus, the "hard" material can hold its shape (or can be deformed and will naturally reassume its shape), whereas the "soft" material requires some support (such as stuffing) to maintain (or regain) its shape.

Thus, this invention provides the marketing advantages of a soft-bodied doll, which is the largest category of dolls, with a drink and wet feature while keeping the soft portion of the doll dry.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A soft-bodied, drink and wet doll, comprising: a hard head having a mouth area with an opening, the opening having a fluid connection to a first coupling disposed interiorly of the doll; a hard butt with an opening, the opening having a fluid connection to a second coupling disposed interiorly of the doll; a soft body connecting the head and the butt and having stuffing therein; and a conduit providing fluid communication between the first and second couplings.

2. The doll of claim 1, wherein the body is connected to the butt by sewing.

3. The doll of claim 1, wherein the soft body comprises a fabric having stuffing therein.

4. The doll of claim 1, wherein the conduit is a tube frictionally engaging a coupling.

5. A method for manufactuing a drink-and-wet doll, comprising:

A. providing (i) a hard head having a mouth area with an opening, the opening having a fluid connection to a first coupling, (ii) a hard butt area with an opening, the opening having a fluid connection to a second coupling, (iii) a soft body covering, (iv) stuffing, and (v) a conduit suitable for conveying liquid;

B. attaching the butt area to the body;

C. attaching the conduit between each of the couplings;

D. placing the stuffing inside the body; and

E. attaching the head to the body.

6. The method of claim 5, wherein the butt is attached to the body by sewing and the head is attached to the body by a tie.

7. The doll of claim 3, wherein the soft body comprises a fabric having a fibrous stuffing.

8. The doll of claim 1, wherein the soft body consists essentially of a fabric having a fibrous stuffing and said conduit.

* * * * *